US012221878B2

(12) United States Patent
Dovland et al.

(10) Patent No.: US 12,221,878 B2
(45) Date of Patent: Feb. 11, 2025

(54) DOWNHOLE TOOL AND METHOD FOR OPERATING THE SAME

(71) Applicant: TARGET Intervention AS, Ålgård (NO)

(72) Inventors: Simen Didden Dovland, Varhaug (NO); Monika Bakke Malmin, Ålgård (NO); Per Egil Almås, Hundvåg (NO); Roger Anda, Kleppe (NO); Kenneth Bergland, Røyneberg (NO)

(73) Assignee: TARGET Intervention AS, Ålgård (NO)

( * ) Notice: Subject to any disclaimer, the term of this patent is extended or adjusted under 35 U.S.C. 154(b) by 19 days.

(21) Appl. No.: 18/010,721

(22) PCT Filed: Jun. 24, 2021

(86) PCT No.: PCT/NO2021/050151

§ 371 (c)(1),
(2) Date: Dec. 15, 2022

(87) PCT Pub. No.: WO2021/262009

PCT Pub. Date: Dec. 30, 2021

(65) Prior Publication Data

US 2024/0102383 A1 Mar. 28, 2024

(30) Foreign Application Priority Data

Jun. 25, 2020 (NO) ..... 20200748

(51) Int. Cl.
*E21B 47/12* (2012.01)
*E21B 17/00* (2006.01)
(Continued)

(52) U.S. Cl.
CPC ..... *E21B 47/12* (2013.01); *E21B 17/003* (2013.01); *E21B 23/01* (2013.01);
(Continued)

(58) Field of Classification Search
CPC ..... E21B 47/12; E21B 47/06; E21B 23/01; E21B 23/06; E21B 33/1208;
(Continued)

(56) References Cited

U.S. PATENT DOCUMENTS 5,960,883 A * 10/1999 Tubel ..... E21B 43/01 166/313
11,591,871 B1 * 2/2023 Randall ..... E21B 33/129
(Continued)

FOREIGN PATENT DOCUMENTS

WO 2014/158028 10/2014
WO 2015051368 4/2015

OTHER PUBLICATIONS

Norwegian Search Report for No. 20200748, dated Jan. 22, 2021.
(Continued)

*Primary Examiner* — George S Gray
(74) *Attorney, Agent, or Firm* — Andrus Intellectual Property Law, LLP

(57) ABSTRACT

A downhole tool conveyable on a coiled tubing string. The downhole tool has: an electric actuator; one or more sensors; and a control unit adapted to receive and interpret data from the one or more sensors, wherein the control unit is adapted to operate the electric actuator in a closed-loop configuration based on data received from one or more of the sensors. A method of operating such a downhole tool.

19 Claims, 14 Drawing Sheets

(51) Int. Cl.

| | |
|---|---|
| ***E21B 23/01*** | (2006.01) |
| ***E21B 23/06*** | (2006.01) |
| ***E21B 33/12*** | (2006.01) |
| ***E21B 34/06*** | (2006.01) |
| ***E21B 43/12*** | (2006.01) |
| ***E21B 47/06*** | (2012.01) |

(52) U.S. Cl.
CPC ..... *E21B 33/1208* (2013.01); *E21B 34/066* (2013.01); *E21B 47/06* (2013.01); *E21B 23/06* (2013.01); *E21B 43/128* (2013.01)

(58) Field of Classification Search
CPC .... E21B 33/124; E21B 34/066; E21B 17/003; E21B 43/128
See application file for complete search history.

(56) References Cited

U.S. PATENT DOCUMENTS

2004/0040707 A1* 3/2004 Dusterhoft ..... E21B 33/124 166/279
2004/0173363 A1* 9/2004 Navarro-Sorroche ..... E21B 47/06 166/387
2008/0230235 A1* 9/2008 Loughlin ..... E21B 33/1285 166/387
2009/0050370 A1* 2/2009 Peters ..... E21B 7/06 175/45
2012/0305315 A1* 12/2012 Bedouet ..... E21B 33/124 175/50
2015/0096745 A1* 4/2015 Wang ..... E21B 47/07 166/250.01
2015/0101864 A1* 4/2015 May ..... E21B 10/32 175/27
2016/0145958 A1* 5/2016 Richards ..... E21B 23/0412 166/65.1
2018/0340377 A1* 11/2018 Eggers ..... E21B 17/046
2020/0080383 A1* 3/2020 Linde ..... E21B 29/00
2020/0102805 A1* 4/2020 Schroit ..... E21B 33/1275

OTHER PUBLICATIONS

International Search Report and the Written Opinion for PCT/NO2021/050151, dated Aug. 16, 2021.
Response to the Written Opinion for PCT/NO2021/050151, dated Apr. 1, 2022.
Second Written Opinion for PCT/NO2021/050151, dated Apr. 26, 2022.
Corrected Second Written Opinion for PCT/NO2021/050151, dated Apr. 27, 2022.
International Preliminary Report on Patentability for PCT/NO2021/050151, dated Aug. 8, 2022.
Anda, Roger "Tube Wire Anchor and Method of Operating the Same", Unpublished U.S. Appl. No. 18/009,225, filed Dec. 8, 2022.

* cited by examiner

DETAIL A (1 : 2)

SECTION B-B (1 : 2)

DOWNHOLE TOOL AND METHOD FOR OPERATING THE SAME

CROSS-REFERENCE TO RELATED APPLICATIONS

This application is the U.S. national stage application of International Application PCT/NO2021/050151, filed Jun. 24, 2021, which international application was published on Dec. 30, 2021, as International Publication WO 2021/262009 in the English language. The International Application claims priority of Norwegian Patent Application No. 20200748, filed Jun. 25, 2020. The international application and Norwegian application are both incorporated herein by reference, in entirety.

FIELD

The invention relates to a downhole tool. In particular, the invention relates to a downhole tool conveyable on a coiled tubing string, wherein the tool is provided with an electric actuator; one or more sensors and a first control unit adapted to receive and interpret data from the plurality of sensors. The invention also relates to a downhole tool assembly as well as to a method for operating the downhole tool assembly.

BACKGROUND

In the search for and exploration of petroleum resources, it is known to log and measure data during operations in a wellbore, such as during drilling, well testing, stimulation, fracking, etc. Typical data that are logged and measured are pressure, temperature, various properties of the surrounding formation, properties of the drilling mud etc. "Logging while drilling" (LWD) is a well-defined term in the industry, implying that data is logged and stored in memory downhole and downloaded when the tools reach the surface. "Measurement while drilling" (MWD) is another well-defined term indicating that data is transmitted to the surface in real-time. The transmission of data usually takes place by means of mud-pulse or electromagnetic telemetry. However, driven by the desire to transfer larger data rates over the last decades, wired drill pipe solutions have been developed, including both "standard" torque-transmitting drill pipes and coiled tubing. Coiled tubing with integrated power and/or communication wires are often referred to as "e-coil".

Even if it is possible to transfer data topside in real-time at high rates, initiating an operation downhole still requires sending a command from topside based on a human decision. For coiled tubing, which has a lower yield-strength than drill pipes, there is an increased risk of downhole tools, conveyed by the coiled tubing, getting stuck in the well, in particular in deviated sections. Use of coiled tubing also entails an increased risk of loss of power and communication from topside. Having to rely on communication with topside for decision making, introduces a latency and increased reaction time which can be highly undesirable in critical situations.

WO 2015/051638 A1 discloses a method for simultaneously determining position and temperature data downhole by use of a magnetostrictive dual temperature and position sensor. Temperature is determined based on a first set of reflections from ultrasonic pulses while position is determined from a second set of pulses, and a processor is used to separate the received reflections.

US 2009/0050370 A1 discloses an apparatus for directional drilling, wherein the apparatus includes an actuator for extending and retracting the force application and a controller operably connected to the apparatus.

US 2015/101864 A1 discloses an intelligent reamer controller that is adapted to detect the difference between rotary drilling and sliding drilling and to respond to the detected changes.

SUMMARY

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect, the invention relates to a downhole tool according to claim 1.

In one embodiment, the electric actuator may be a linear actuator operated by means of an electromotor. In another embodiment, the downhole tool may, in addition or as an alternative, comprise one or more electric rotary actuators.

In embodiment one or more of the sensors may be adapted to measure work exerted by the electric actuator when operating one or more elements of the downhole tool. The first control unit may further be adapted to stop the operation of the element when the work measured by one or more sensors reaches a predefined limit. The first control unit may further be adapted to operate the electric actuator to operate the element at a first speed at an initial stage of an operation and a at a second speed, which is lower than the first speed, at a later stage of the operation as will be explained in more detail below.

The element operable by means of the electric actuator may be a sealing element expandable to a sealing engagement with an inside of a pipe string in the wellbore to isolate a section of a well bore above sealing element from a section of the wellbore below the sealing element. In addition, or as an alternative, the element may be an anchor for anchoring the downhole tool in the well. As a further addition or alternative, the element may be a valve or a pump.

As an example, a sensor may be adapted to measure the work exerted by the electric actuator when expanding a sealing element to a sealing engagement with the inside of a pipe string. Sensor data on the work is communicated to and interpreted by the downhole first control unit. The first control unit may stop the expansion of the sealing element when the measured work reaches a pre-defined level. In this way, it may become possible to monitor the force by which a sealing element, such as a packer, is set in the wellbore and to avoid excessive, and possibly damaging, forces acting on the actuator and sealing element. The overall command of initiating expansion/setting of one or more packers may be transmitted from a topside, second control unit, as included in the downhole tool assembly described herein. When the command is received by the downhole, first control unit, the first control unit operates the electric actuator to expand the sealing element. During expansion the work exerted by the actuator is monitored and fed back to the first control unit in a closed loop. When a pre-set work limit is reached, the actuator stops. A signal may in certain embodiments then be sent to the second control unit confirming that the sealing element has been set. In one embodiment, as disclosed above, the actuator may be also adapted to expand the sealing element with a first, high power (corresponding to a high speed in one embodiment) at the beginning of the expansion, and then subsequently, when approaching the work limit, reducing the power (speed) to a second, lower power (speed) to ensure efficient, controlled and reliable setting of the sealing element. In another embodiment, a similar process may be used when operating an anchor, a valve or any other element in the downhole tool operated by means of the second control unit and the electric actuator.

In one embodiment, the downhole tool may be provided with two or more sensors for measuring the pressure in the well, wherein at least one of the sensors is provided above the sealing element on the downhole tool and wherein at least one sensor is provided below the sealing element on the downhole tool. In this way, the forces acting on the tool, from pressure differences between the upper and lower sides of the sealing element, when in an expanded position, may be monitored and reacted to. The downhole tool may, in one embodiment, be provided with a mandrel extending axially at least across a portion of the downhole tool where the expandable sealing element is provided, wherein an axial bore in the mandrel allows for fluid circulation axially through the tool independently of the position/state of the expandable sealing element, and wherein real-time communication with, and optionally power to, the sensor below the expandable sealing element is provided by means of one or more wires provided in an axial bore in the wall of the mandrel. Establishing real-time communication with a sensor provided below the sealing element, and in an embodiment with a plurality of sealing elements, below the lowest sealing element, enables monitoring of the pressure in the well below the downhole tool in real-time, which may be a huge benefit. It has been shown to be challenging to establish real-time communication with a sensor across a zone with a sealing element provided around a fluid-carrying mandrel. By providing an axial bore in the mandrel along the along the zone of the sealing element(s) it becomes possible to establish communication with and optionally also provide power to the sensor below the sealing element without comprising the sealing efficiency of the sealing element and without interfering with flow through the mandrel. In one embodiment, because of the length of the downhole tool, the axial bore in the wall of the mandrel may be provided by pre-drilling hole in segments of the mandrel that are subsequently welded together.

In one embodiment, the downhole tool may be an isolation tool, and wherein the downhole tool further comprises:

- at least two expandable sealing elements adapted to isolate a section of the wellbore therebetween;
- one or more fluid ports provided between the expandable sealing elements and adapted to be in fluid communication with the coiled tubing string; and
- sensors for measuring the pressure in the well, where at least one sensor is provided above the upper expandable sealing element and one sensor is provided below the lower expandable sealing element. In other embodiments the downhole tool may be a fracking tool, a tool for chemical injection, well testing or matrix stimulation etc. One embodiment of such a fracking tool is disclosed in the applicant's own WO2014/158028 A1.

In one embodiment, the downhole tool may include sensors for measuring the position, speed and force exerted by the electric actuator. By monitoring one or more of, or preferably each of, these variables (position, speed and force) a very precise operation of the element (such as sealing element, valve, anchor) may be provided. It may also be possible to detect problems such a scale or influx of sand in the well if a force reading exceeds a predetermined limit before an end position is reached. In one embodiment, one or more strain gauges placed on the element that is being operated, such as on a packer, may be used to measure force. In addition, or as alternative, the force may be calculated based on the speed and power consumption of the electric motor. Speed of the electric actuator may in one embodiment be measured indirectly by measuring the rotational speed of the motor and from there calculating the speed of the actuator. Similarly, also the position of the electric actuator may be measured indirectly by measuring the rotation of the motor. In one embodiment, the actuator may be provided with an end stop switch adapted to sense that the electric actuator has come to one of its end points. In one embodiment, the first control unit may use a detected end point to verify and/or re-calibrate the position of the electric actuator.

In a second aspect, the invention relates to a downhole tool assembly according to claim 13. Communication between the second control unit, located topside, and the first control unit, located downhole, typically take place via wires extending along the electric coiled tubing, inside or outside the tubing or in the wall of the pipe itself. An electric coiled tubing with power and communication wires is often referred to as an "e-coil" in the industry.

In one embodiment, the first control unit, upon loss of communication with second control unit, may be adapted to automatically reset one or more elements of the downhole tool to a fail-safe or idle position. In a situation where communication is lost, but where the downhole tool is not stuck in the well, it may be desirable to pull the downhole tool out of well by means of the coiled tubing. The logic in the first control unit may understand that communication with topside has been lost, and first control unit will then be adapted to operate the downhole tool e.g. to retract expanded sealing elements and/or slips/anchors and/or to open closed valves as necessary to make it possible to retrieve tool from the well. Power to perform these resetting operations may be provided from topside via the coiled tubing and/or by means of back-up batteries provided in the downhole tool. Power to operate the electric actuator is typically provided from topside. However, for emergency situations, where also power from topside is lost, it may be useful if the downhole tool is provided with one or more back-up batteries with sufficient power to reset the downhole tool to an idle and/or fail-safe state where it can be pulled out from the well.

In one embodiment, the first control unit may be adapted to recognize a command in the form of a mechanical or acoustic signature transmitted via the coiled tubing or via a circulating fluid. It may occur that communication with and power from topside is lost altogether and/or if the automatic resetting of elements disclosed above still does not allow pulling the downhole tool out of the well. If this happens, it may be beneficial if the first control unit is adapted to recognize a command in the form of a mechanical or acoustic signature transmitted via the coiled tubing or alternatively via a circulation fluid to initiate an automatic release of one part of the downhole tool from another part of the tool. Even if communication between the two control units is no longer possible, it may still be possible to transmit commands from topside and down to the first control unit. The logics incorporated into the first control unit may understand that communication with topside has been lost, and it will be programmed to start "listening" to the mentioned signatures. When such a signature has been sensed and recognized by the first control unit initiates a release procedure as mentioned above. A mechanical signature transmitted via the coiled tubing may be transmitted as strain and/or compression patterns in the coiled tubing or optionally as pressure pulses in a circulating fluid. An acoustic signature may be generated by percussive strokes applied to the coiled tubing with a hammer or similar.

In a third aspect, the invention relates to a method for operating a downhole tool assembly according claim 16.

In one embodiment, the method may further include, prior to executing a command, the step of sending the command from the second control unit, located topside, to the first control unit on the downhole tool. The downhole tool according to the present invention is provided with a first control unit and one or more sensors, where the first control unit is adapted to operate the downhole tool in a closed loop configuration based on data sensed by the one or more sensors. This implies that overall, general instructions/commands, such as "expand sealing element", "set anchor", "close valve", etc, may be transmitted from an operator via the second control unit topside, while the implementation of the commands may be performed autonomously by the tool downhole without involvement from an operator and without communication with topside. After the operation has been finalized, e.g. after a valve has been closed, a signal may be transmitted from the first control unit to the second control unit to confirm that the job has been finalized.

In one embodiment, the method may further comprise the steps of:

sensing a pressure in the well by means of the one or more sensors; and if the pressure exceeds a pre-defined level, adjusting the pressure in the well by operating a pump and/or valve device from the first control unit in closed loop configuration. During such operations as setting of packers, closing of valves etc. the downhole tool may be constantly monitoring temperature, pressure and forces acting on the tool in real-time by means of the plurality of sensors. Pressure sensors will typically be provided above the upper sealing element, between the sealing elements and preferably also below the lowest sealing element, when two or more sealing elements are provided. Forces acting on the tool as well as the tool's orientation may be measured by means of sensors and fed back to the first control unit as well as to the second control unit. An operator may interpret the data sent topside, while the first control unit is also provided with logics enabling it to react and operate in closed loop configuration in the event that something unforeseen should occur. In one embodiment, if the first control unit receives information that huge forces are acting on the tool due to pressure differences above and below the downhole tool, i.e. pressure gradients across the downhole tool, the logic in the first control unit may be adapted to operate the pump rate of a topside pump and/or to open a downhole relief valve to reduce or equalize the pressure difference. This "pressure self-balancing" logic may enable use of the tool without the need for separate anchors/slips for anchoring the tool in the well in addition to the packers, since the forces acting on the tool from the pressure differences are monitored and controlled in real-time and may be kept below a pre-defined limit. The downhole tool may therefore in certain embodiments be provided without anchors/slips.

The method may further include steps of by means of the first control unit, sensing that communication with topside has been lost;

automatically operating one or more elements of the downhole tool to a fail-safe or idle position. The benefits of enabling the downhole tool to automatically and autonomously reset were described above.

BRIEF DESCRIPTION OF THE DRAWINGS

In the following is described examples of preferred embodiments illustrated in the accompanying drawings, wherein.

DETAILED DESCRIPTION OF THE DRAWINGS

Figure 1:
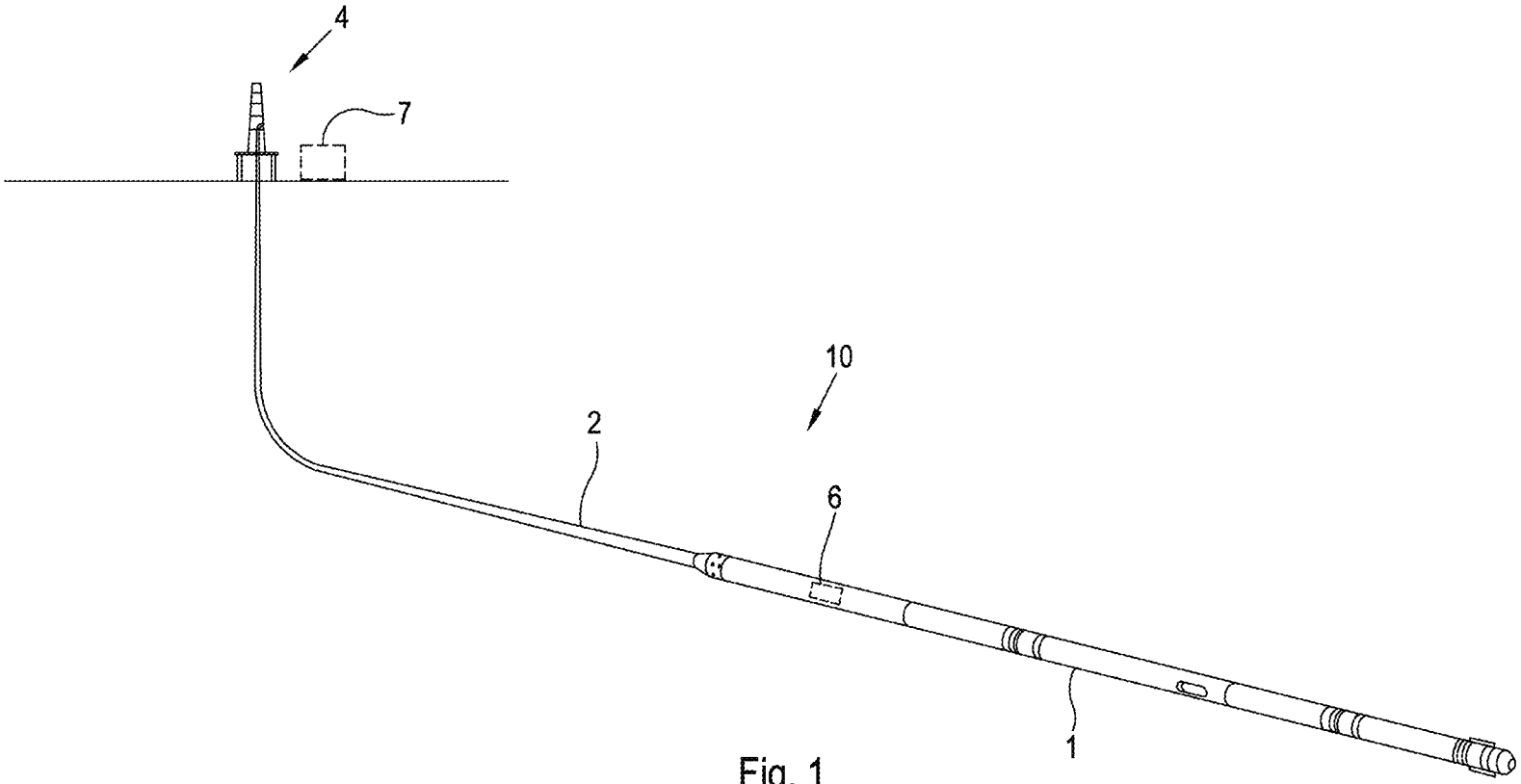
FIG. 1 shows an embodiment of a downhole tool assembly according to the invention.

In the following, the reference numeral 1 will be used to denote a downhole tool according to the first aspect of the invention, whereas reference numeral 10 will be used to denote a downhole tool assembly according to the second aspect of the invention. Identical reference numerals refer to identical or similar features in the drawings. The drawings are shown simplified and schematic, and various features therein are not necessarily drawn to scale.

FIG. 1 shows a downhole tool assembly 10 according to second aspect of the invention. The tool assembly comprises a downhole tool 1 according to the first aspect of the invention. The downhole tool 1 is connected to a coiled tubing 2 run into a not shown wellbore from a topside surface unit 4. The downhole tool 1 is provided with a first/downhole control unit 6 adapted to operate the downhole tool 1 in closed loop configuration as disclosed herein. A second control unit 7 is provided topside and adapted to communicate with the first control unit. The downhole tool 1 is adapted to receive power from and to communicated with topside via the coil tubing as also disclosed herein.

Figure 2:
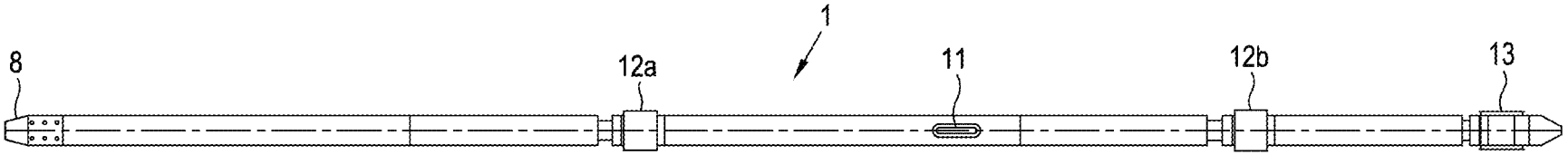
FIG. 2 shows a downhole tool according to the invention.

FIG. 2 shows downhole tool 1 according to the first aspect of the invention separate from the other parts of the downhole tool assembly 10. In the shown embodiment, the downhole tool 1 is provided with a coiled tubing connector 8, adapted to mate with/connect to a complementary fitting connector on the coiled tubing for mechanically connecting the downhole tool to the coil tubing and for the connection of power and communication. The downhole tool 1 is provided with two sealing means 12, here in the form of reversible expandable packers 12*a, b* provided with an axial distance between them along the downhole tool. Between the packers 12, a, b the downhole tool 1 is provided with fluid ports 11, of which only one can be seen in the drawing. At its lower/distal end, the downhole tool is provided with an anchor 13 in the form of slips that may be set to anchor/securely fasten the downhole tool 1 in the wellbore.

Figure 3A:
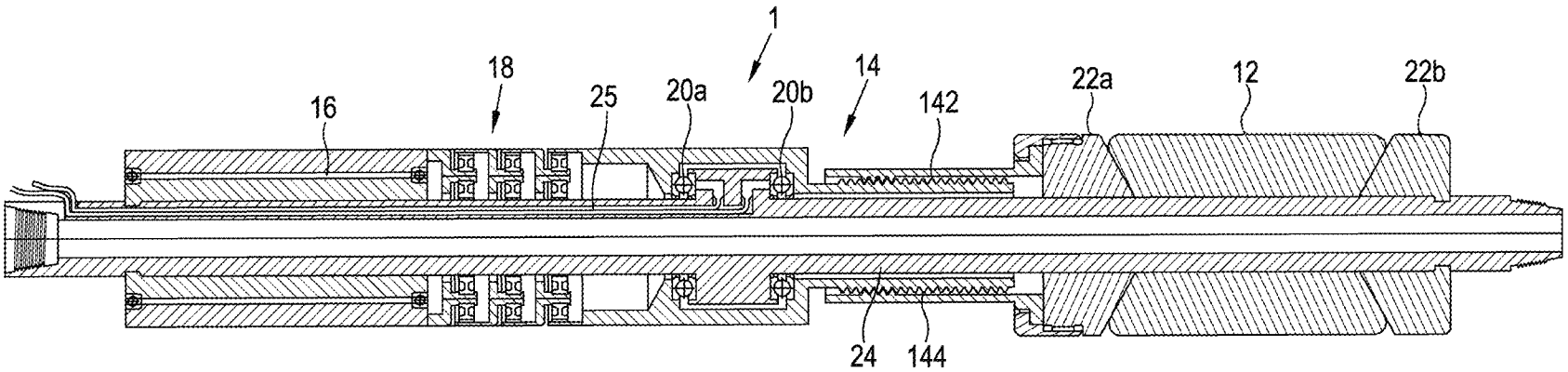
FIGS. 3*a*-3*b* show, in detailed cross-sections, a first embodiment downhole tool according to the invention in a first position of use.
Figure 3B:
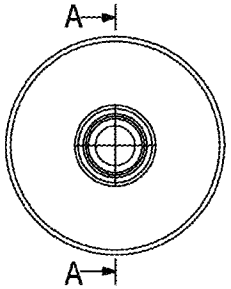
Figure 4A:
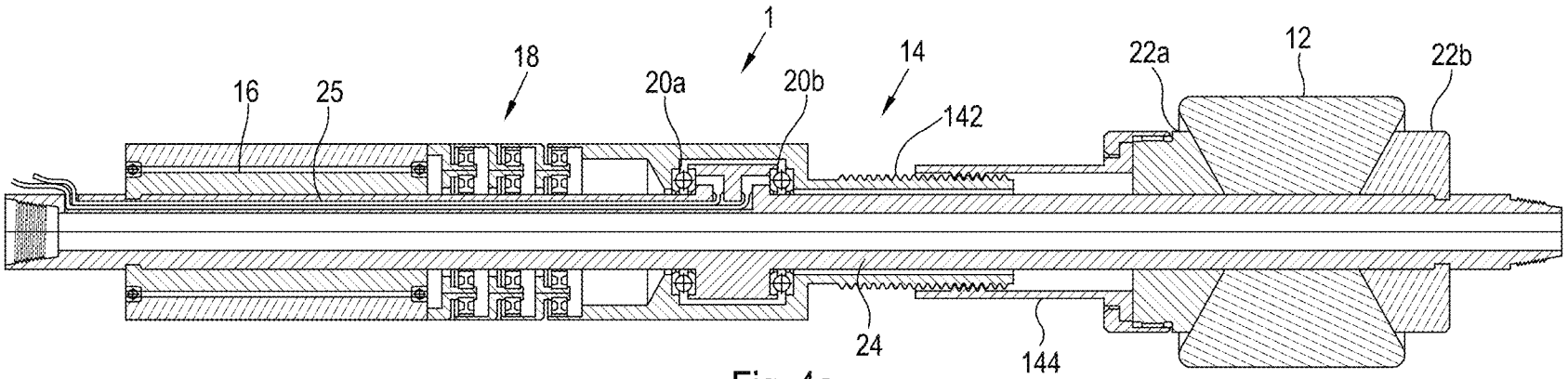
FIGS. 4*a*-4*b* show, in detailed cross-sections, the downhole tool from FIG. 3 in a second position of use.
Figure 4B:
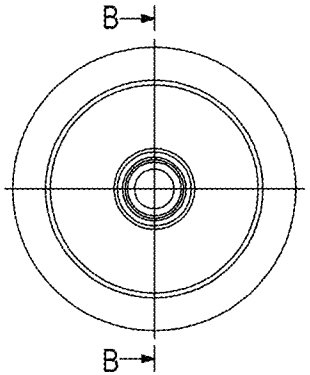

FIGS. 3*a*-3*b* show cross-sections of a first embodiment of a downhole tool 1 according to the first aspect of the invention in a first position of use. A sealing element/packer 12 represents the operable element. In the shown embodiment, the electric actuator is a linear actuator 14 operable by means of an electromotor 16 via a set of gears 18. Sensors 20*a, b* are provided to measure work exerted by the linear actuator 14 when setting the packer 12. A threaded shaft 142 of the linear actuator 14 is rotatable to create a linear motion in a sleeve 144 with complementary fitting inner threads. The sleeve 144 abuts and pushes a first wedge 22*a* against a complementary fitting first oblique portion of the packer 12. The first wedge 22*a* is axially movable on mandrel 24 of the downhole tool 1. A second wedge portion 22*b* is non-movably arranged on the mandrel 24 on the other side of the packer 12, complementary fitting to a second oblique portion of the packer 12. By driving the linear actuator 14 to the right in the drawing, the packer is pushed/squeezed out radially towards the inner surface of a not-shown pipe string in the wellbore to create a sealing engagement, as indicated in FIGS. 4*a*-4*b*. The packer 12 may be released from the sealing engagement by driving the linear actuator 14 in the opposite direction, i.e. to the left in the drawing. While setting the packer 12, the work exerted by the linear actuator is measured by the sensors 20*a, b* and fed to the first control unit, not shown in this figure, via sensor wires 25 embedded in the wall of the mandrel 24.

Figure 5A:
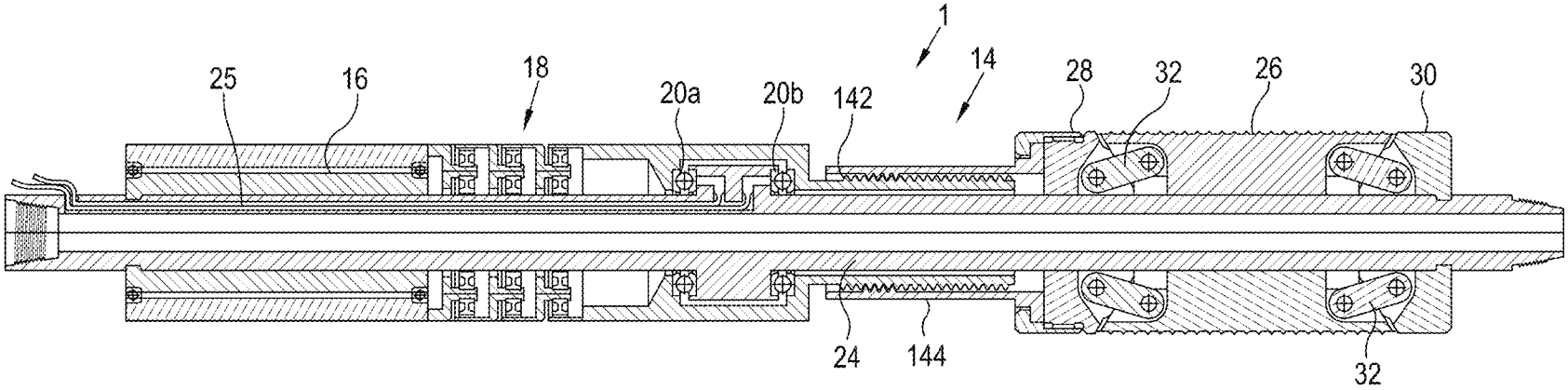
FIGS. 5*a*-5*b* show, in detailed cross-sections, a second embodiment of a downhole tool according to the invention is a first position of use.
Figure 5B:
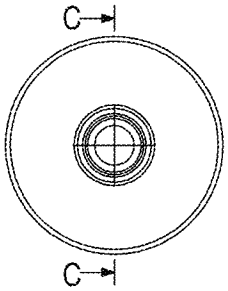
Figure 6A:
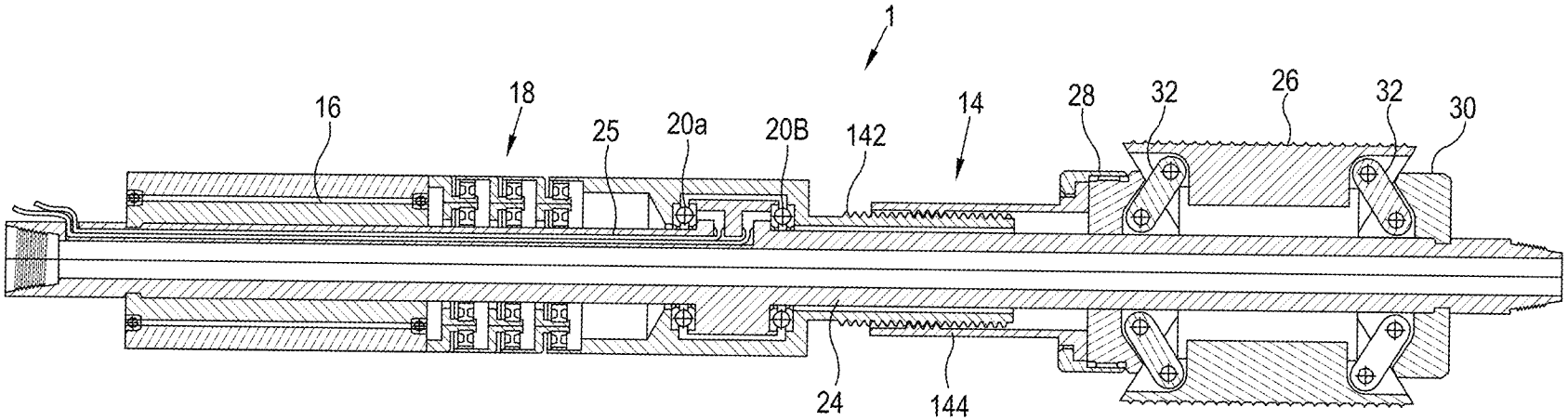
FIGS. 6*a*-6*b* show, in detailed cross-sections, the downhole tool from FIG. 5 in a second position of use.
Figure 6B:
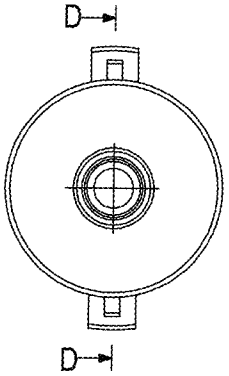

FIGS. 5*a*-5*b* show similar cross-sections of a downhole tool 1 with a similar configuration as in FIGS. 3*a*-3*b* and 4*a*-4*b*, but where the element operable by the linear actuator 14 is an anchor/slips 26 for anchoring the downhole tool 1 in the wellbore. In the shown embodiment, the slips 26 is activated/expanded by driving the linear actuator to the right, where the sleeve 144 of the linear actuator 14 pushes a first abutment plate 28, axially movable on the mandrel 24, towards the slips 26. On its distal end, the slips 26 abuts a second abutment plate 30, non-movably arranged on the mandrel 24. Between the first and second abutment plates 28, 30 and slips 26 are provided pairs of link arms 32. When the linear actuator 14 is driven to the right in the drawing, the force exerted by the linear actuator 14 on the first abutment plate 28 pushes the slips 26 radially out towards the inside of a not shown pipe string in the wellbore by rotating the link arms 32 from the position shown in FIGS. 5*a*-5*b* to the position shown in FIGS. 6*a*-6*b*. The slips 26 may be retracted by driving the linear actuator 14 in the opposite direction, i.e. to the left in the drawing.

Figure 7A:
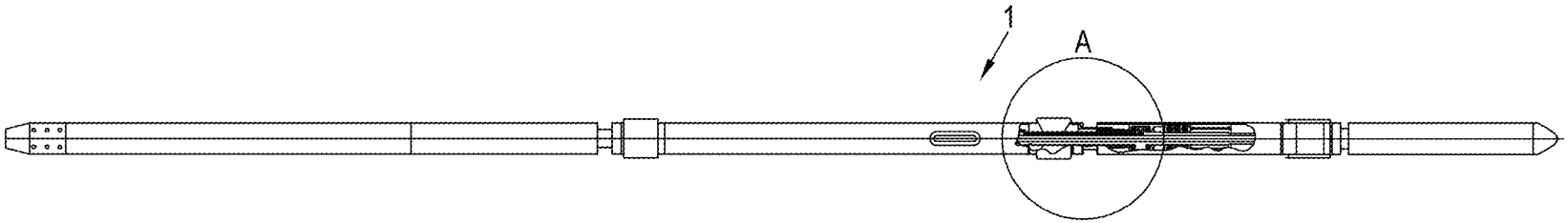
FIGS. 7*a*-7*c* show an embodiment of a downhole tool according to the invention, as well as an enlarged detail and a detailed cross-section of the downhole tool.
Figure 7B:
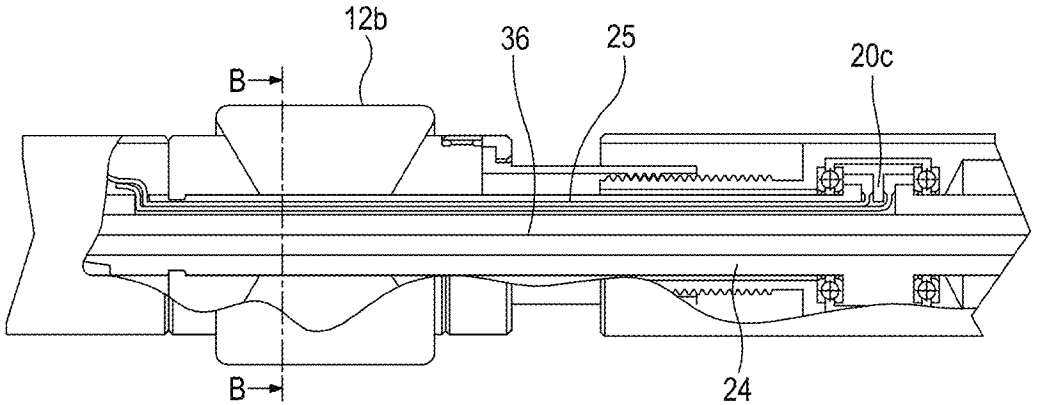
Figure 7C:
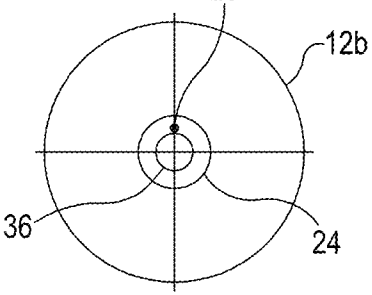

In FIGS. 7*a*-7*c* an embodiment of a downhole tool 1 is shown where the mandrel 24 is formed with an axial bore 36 its wall, and where sensor wires 25 extend across the region of the lower packer 12*b*, to a sensor 20*c*, as best seen in the enlarged detail A and cross-section B-B. The sensor 20*c* is adapted to measure the pressure in the wellbore below the lowermost packer 12*b*, enabling real-time measurement of pressure in the wellbore below the downhole tool, also when the lower packer 12*b* is in an expanded, sealing state. Fluid-circulation through the main axial flow bore 36 of the mandrel is not affected by the expansion state of the packer.

Figure 8:
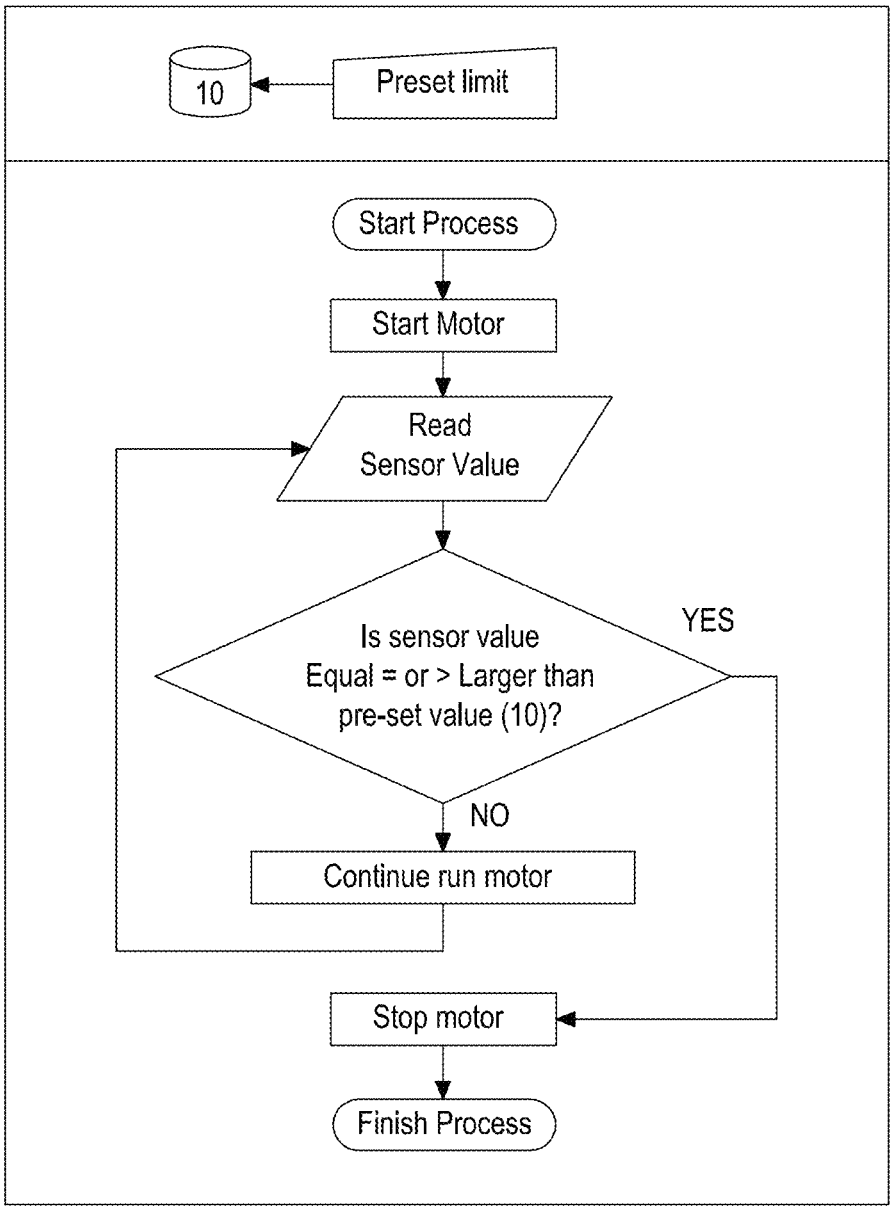
FIGS. 8-13 show flow diagrams of various operations of use of the downhole tool assembly according the invention.

FIG. 8 is a flow diagram showing an operational use of a tool assembly according to the present invention. A pre-set maximum limit for work that may be exerted by the electric actuator is set in the first control unit. The maximum limit may be embedded in the first control unit, or it may be sent as a command value from the second control unit, located topside. In this exemplary embodiment, the value is set to 10. The first control unit initiates the process by sending a command to start the electromotor. The sensor value is read and fed back to the first control unit in closed loop configuration. If the read value is below the pre-set limit, then motor continues to run to operate the linear actuator. When the preset sensor value limit is reached, the first control unit stops the operation of the motor, whereby excess forces acting on packers, slips, valves etc. may be avoided and at the same time it is ensured the same elements are set with a sufficiently high force. The sampling frequency may be in the order of 1-10 Hz, though lower and higher frequencies may be appropriate in certain embodiments.

Figure 9:
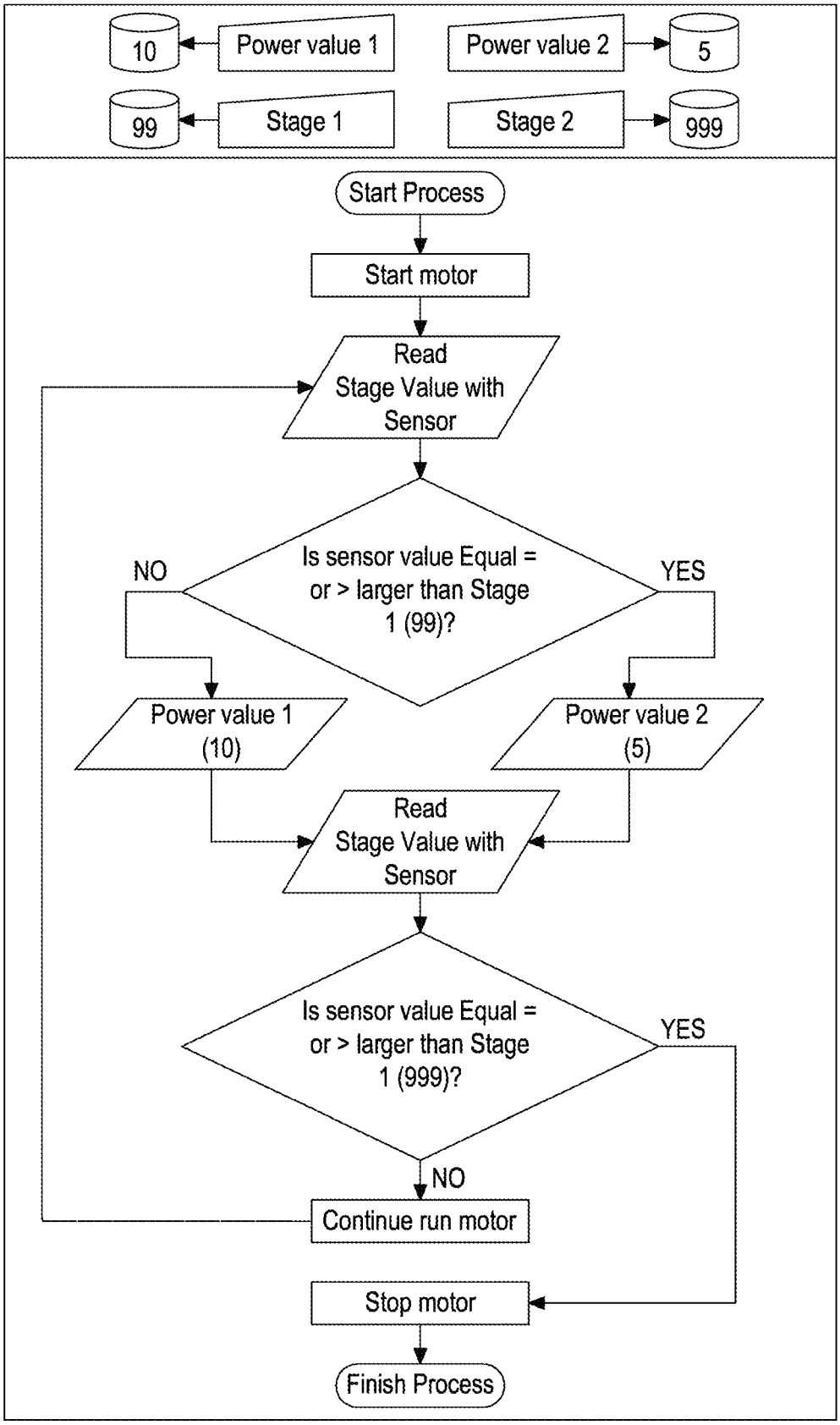

FIG. 9 shows a flow diagram where the electromotor is adapted to operate an element, via the linear actuator, at a first power at an initial stage of an operation and at a second power, lower than the first power, at a second stage of the operation. In certain operations, the force may influence the speed by which the linear actuator moves. Before start, a first power value and a second power value are set by which the electromotor is to operate based sensor value readings. In the exemplary embodiment, for simplicity, the first power value is set to 10 and the second power value is set to 5. A first stage value and a second stage value are set to 99 and 999, respectively, in the exemplary embodiment. The values may be embedded in the first control unit, or the values may be sent as commands from the second control unit, located topside. The first control unit, located downhole, initiates the process by starting the electromotor. The sensor value is read and fed back to the first control unit. The sensor value that is read, may be a force or position of the linear actuator, position of a valve, packer, position, anchor, etc. When the sensor value is below 99, the electromotor operates at a power of 10. When the sensor value increases to be equal to or larger than 99 but lower than 999, the electromotor operates at a power of 5. When the sensor value is 999 or larger, the first control unit finishes the process by stopping the motor. In one embodiment, this process may be used to let the electromotor set an anchor, packer, valve etc. at a first speed, by operating at a first power, at the first stage of the process, and then reduce the speed as the sensor value approaches its pre-set maximum limit, whereby a more accurate activation of the element being operated may be achieved without comprising the efficiency of the operation too much.

Figure 10:
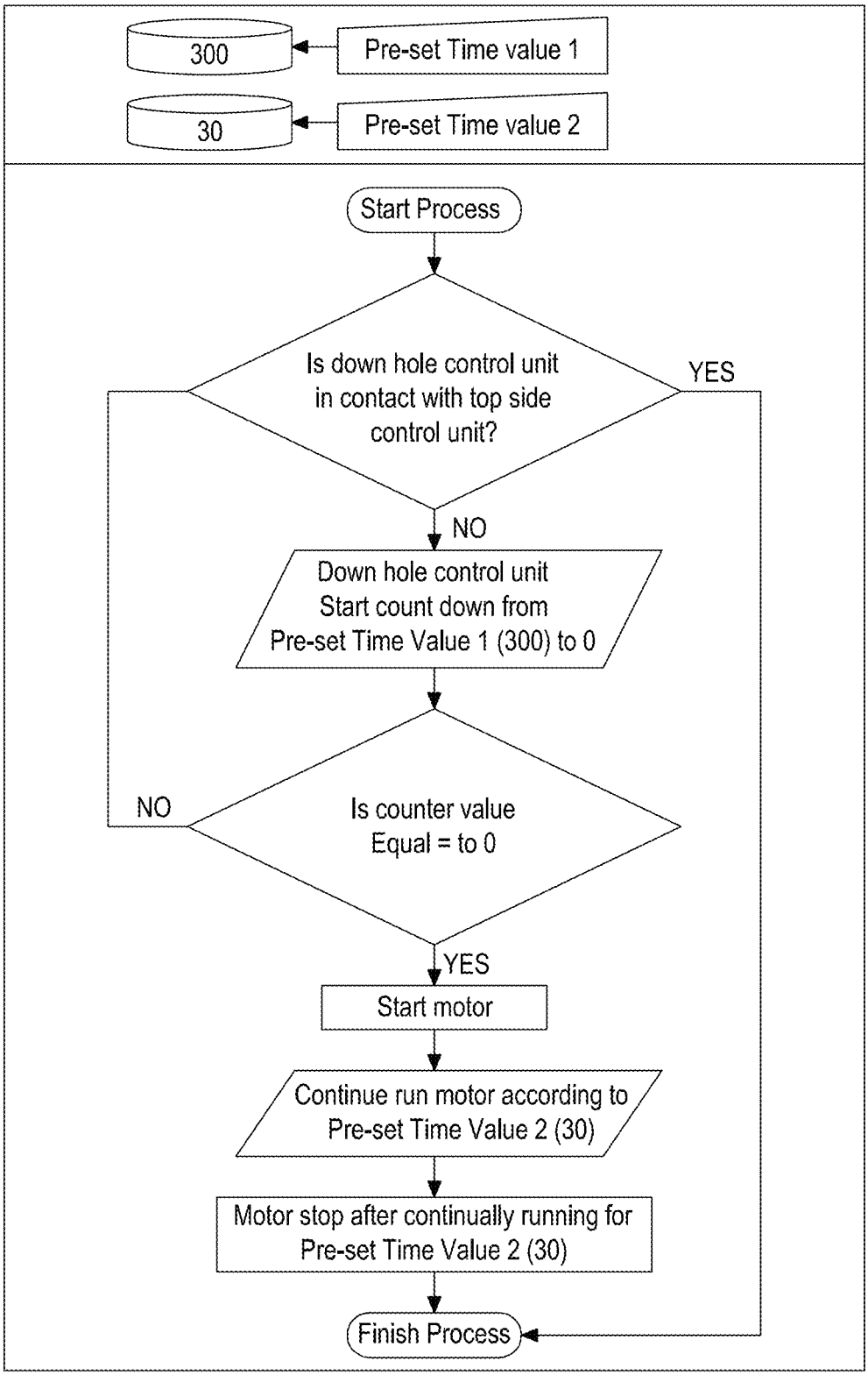

FIG. 10 shows a flow diagram where one or more operable elements of the downhole tool may be reset to a fail-safe or idle position upon loss of communication between the first and second control units, being located downhole and topside, respectively. First and second time values are set in the downhole control. In the exemplary embodiment, the first time value is set to 300 while the second time value is set to 30. The process is started by the first control unit checking if it is in communication with the second, topside communication unit. If it is able to receive a control signal from the topside control, unit the process stops. If no signal is received, the first control unit starts counting down from the first preset time value, here 300. While counting down, the first control unit makes several attempts in getting in contact with the second control unit, located topside. If no contact has been made when the counter reaches 0, this is an indication that communication with topside has been permanently lost. The electromotor is then started and is allowed to run for a pre-determined time, corresponding to the second pre-set time value. When the electromotor has run for the second pre-set time value it stops. The electromotor may operate any element, such as packers, valves, anchors etc. that need to be reset in order to be able to pull the downhole tool out of the wellbore by means of the coil-tubing. In certain embodiments, one electromotor may be adapted to operate several elements in sequence, such as closing a valve, setting and packer and optionally also an anchor. In addition or as an alternative, a plurality of motors may be provided, where one or more of the motors may operate one element or a sequence of element.

Figure 11:
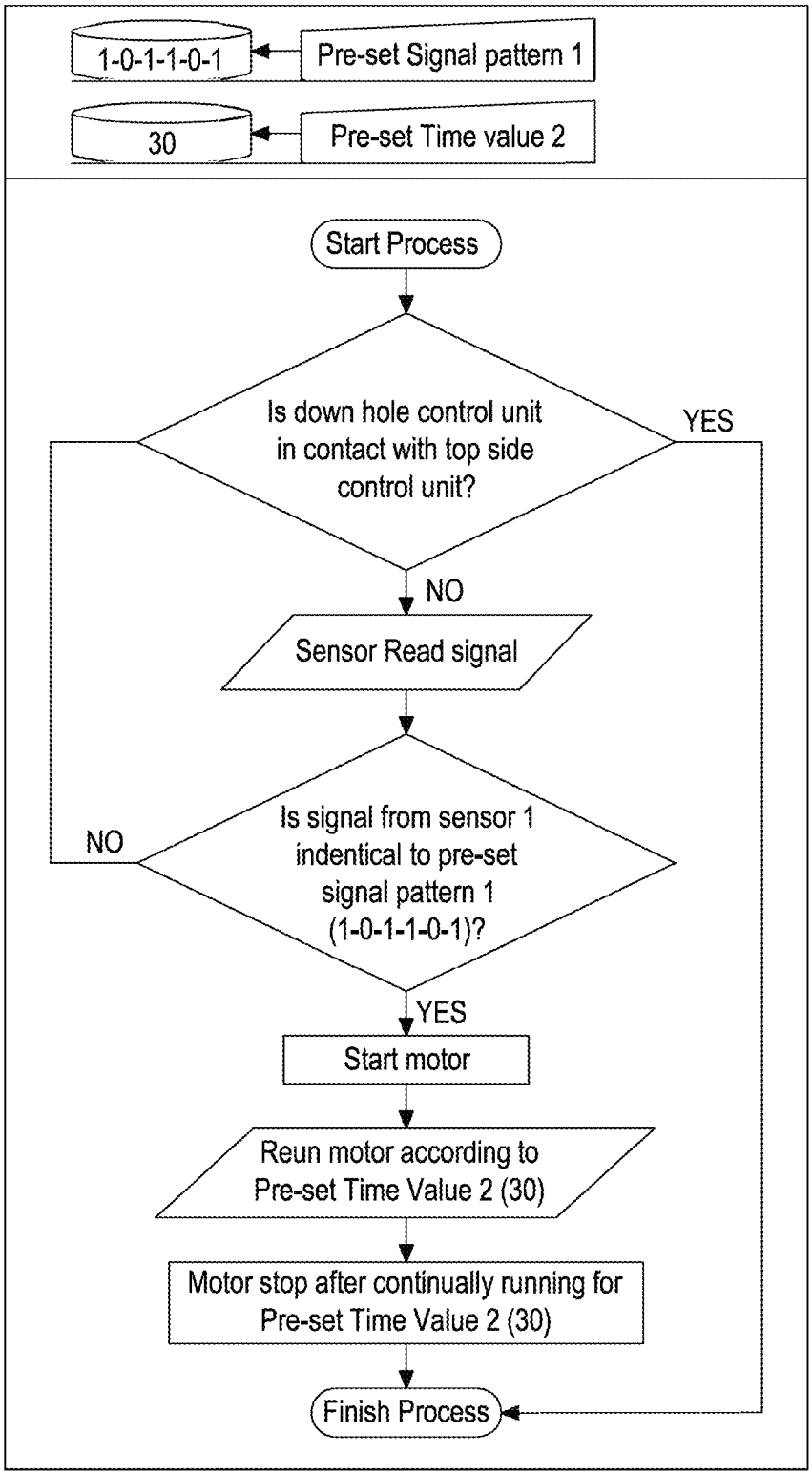

FIG. 11 is a flow diagram showing an example of how the first control unit may be adapted to sense and recognize a command, sent from topside, in the form of an acoustic or mechanical signal transmitted via the coiled tubing. A pre-set signal pattern and a pre-set time value are embedded in the first control unit. The signal pattern is here exemplified by a binary pattern 1-0-1-1-0-1, while the time value is set to 30. The process starts as in FIG. 10, with the first control unit verifying whether or not it is able to establish "normal" signal communication with the second control unit and or if the tool is stuck despite resetting of element. If "yes", the process is finished. If the first control unit is not able to establish normal contact with the second control unit, it starts listening for the pre-set signal pattern, which may then be communicated via the coiled tubing e.g. as an acoustic pattern created percussively with a hammer or similar, mechanically by pulling the coiled tubing or by pressure pulses in a fluid circulating in the coiled tubing. If the first control unit senses and recognises the pre-set signal pattern, the electromotor is started to run for a time set according to the pre-set value. As in the flow diagram of FIG. 10, the electromotor runs to reset elements of the downhole tool to an idle or fail-safe position so that the downhole tool may be pulled out of the well by means of the coiled tubing.

Figure 12:
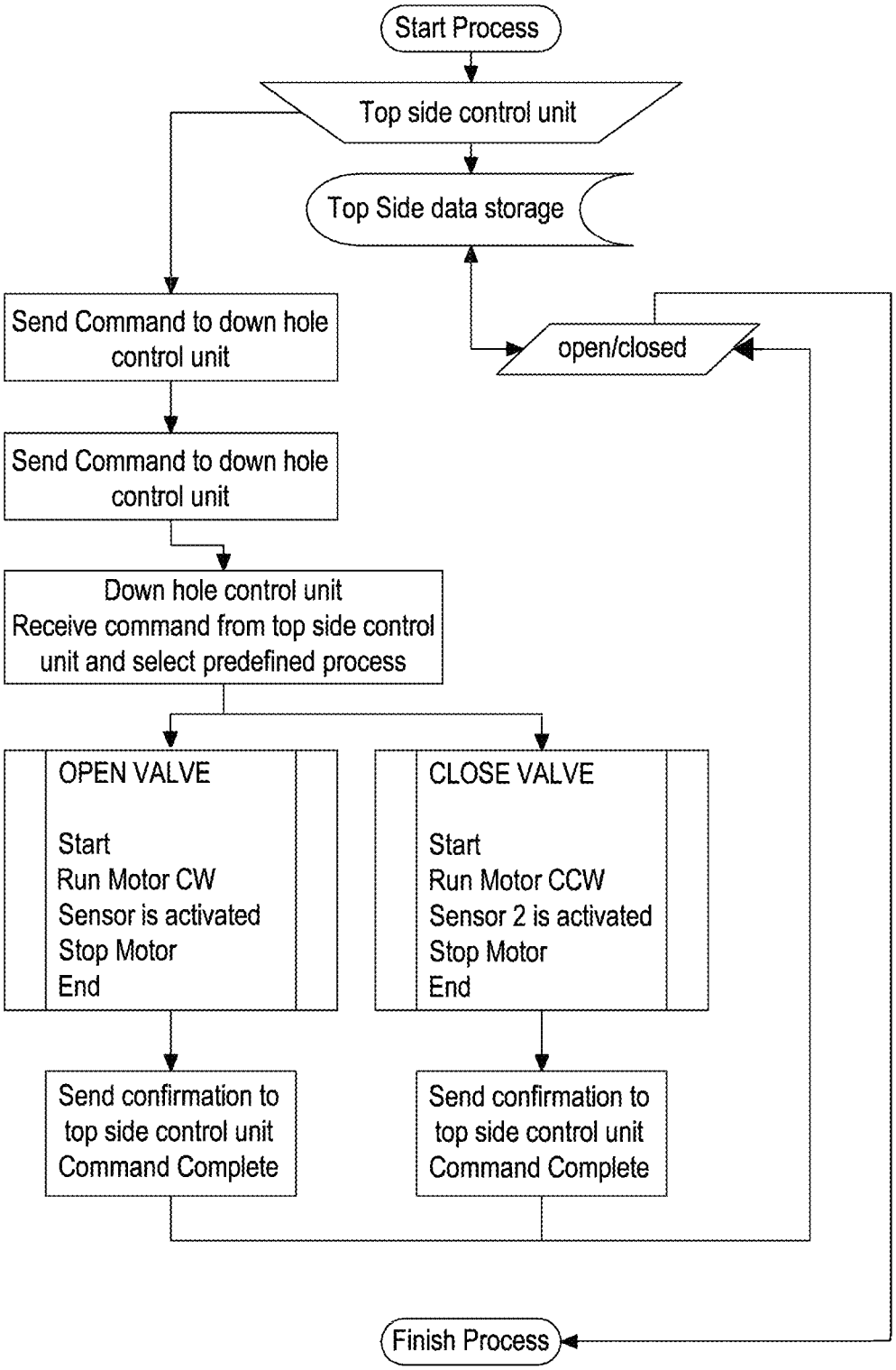

FIG. 12 shows a flow diagram where an overall command is sent from the second control unit, located topside, to the first control unit, located downhole. The first control unit, after receiving the overall command from topside, executes the command in a closed loop configuration. Only after the command has been executed, a signal is sent to topside to indicate that the operation has been completed. The process is started topside by the second control unit sending a command to the first control unit. The command from the second control unit may be initiated by an operator or automatically/autonomously by the second control unit. In the exemplary embodiment, the overall command sent from topside is to open or close a valve. The first control unit. Located downhole, starts the electromotor and performs the operation while also reading sensor values, as e.g. shown in the flow diagrams of FIGS. 8 and 9. When the process is completed a confirmation signal is sent to topside that the valve has now been opened/closed, whereby a topside data storage is updated with the new status information. This may significantly improve efficiency and reliability of the operation of the downhole tool since only a small amount of data needs to be communicated between topside and downhole.

Figure 13:
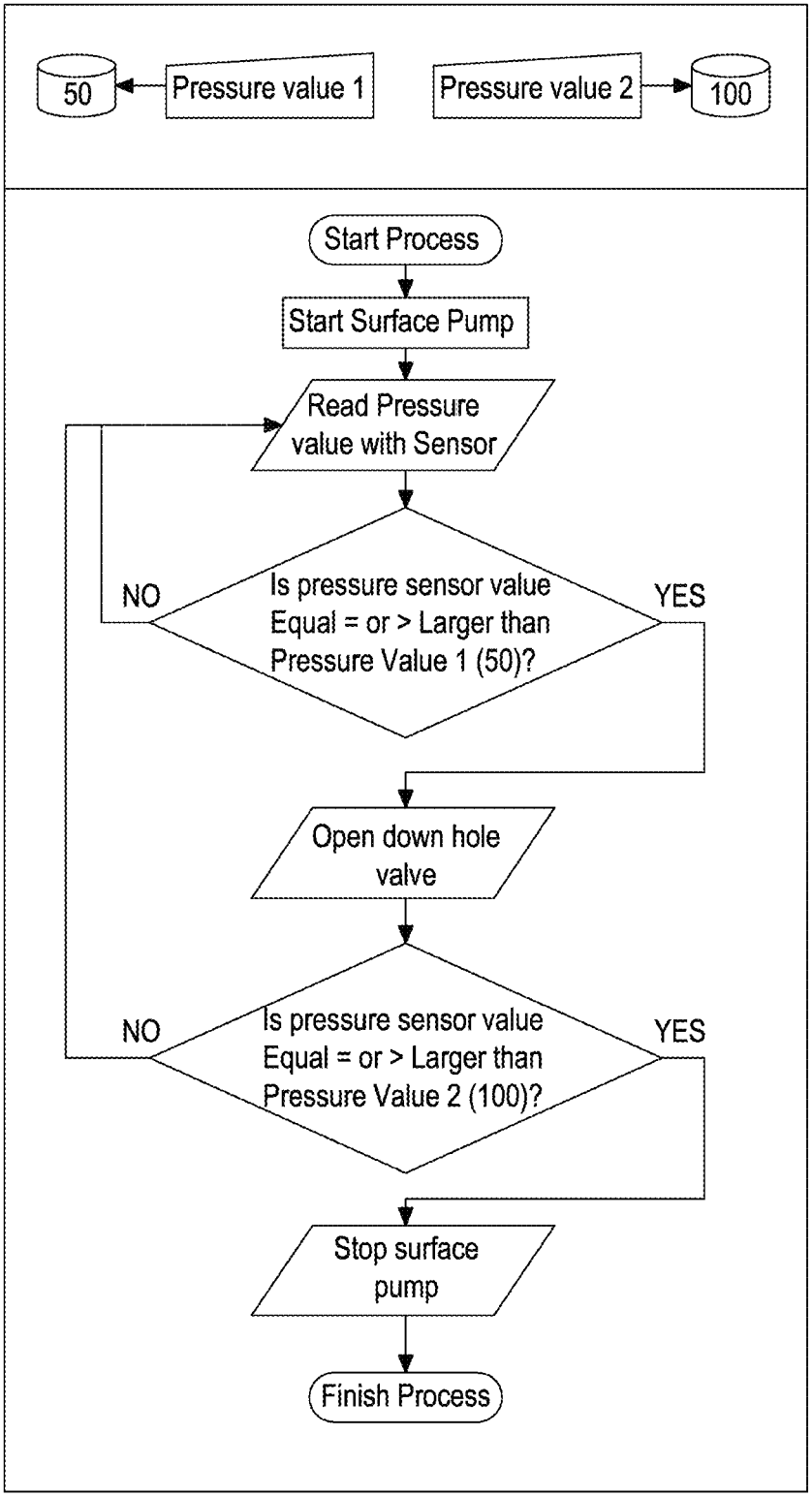

FIG. 13 is an exemplary flow diagram showing how sensor value readings on the downhole tool can be used to automatically adjust the pressure in the well near the tool as disclosed herein. First and second pressure values are set in the first control unit, located downhole. In the shown embodiment, these values are exemplified by 50 and 100, respectively. The process is initiated by starting a topside/surface mud circulation pump. Pressure values are read by downhole pressure sensor. When the read pressure value is below the first pre-set limit, the pump continues to operate, and no further action is taken. If the read pressure value is equal to or larger than the first set pressure value, the first control unit opens a valve on the downhole tool to equalize a pressure difference and to reduce the pressure. If the read pressure value, after opening of the valve, is equal to or greater than the second pre-set pressure value, then the topside pump may be ramped down or stopped to further reduce the pressure. In this way, the first control unit, located downhole, may ensure that an absolute pressure or a pressure differential is kept below a pre-set limit as disclosed herein. It should be noted that the processes of operating a valve and/or a pump may be done separately for regulating the pressure and need not be run in sequence. The operation of a valve and/or a pump may also be used to increase pressure if it falls below a certain limit. Operating a valve may also be done so as to increase or reduce its opening rather than fully close or open. Similarly, operating a pump may be done by ramping up or reducing its circulation rather than only start or stop the pump. In this way the pressure around or pressure gradient across the downhole tool in the well may be balanced and kept within a certain interval.

Figure 14:
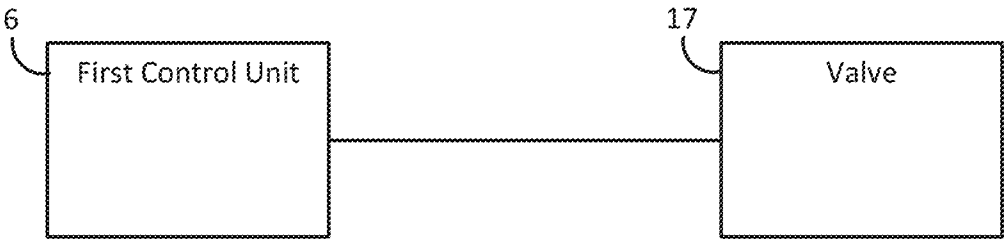
FIG. 14 shows a control unit in communication with a valve element of the downhole tool assembly according to the invention.

FIG. 14 shows first control unit 6 and a valve 17, which may be included in downhole tool 1 to control. A person of skill in the art would understand how a valve can be integrated into and used in a downhole tool disclosed herein. As described above, valve 17 can be operated by first control unit 6 to adjust pressure in the well. For example, as described above (e.g., in connection with FIG. 13) the first control unit may operate valve 17 for regulating pressure in the well near the tool. As another example, as described above, the first control unit can operate a pump and/or valve 17 in closed loop configuration if the pressure in the well exceeds a pre-defined level. In one embodiment, if the first control unit receives information that huge forces are acting on the tool due to pressure differences above and below the downhole tool, i.e. pressure gradients across the downhole tool, the logic in the first control unit may be adapted to operate the pump rate of a topside pump and/or to open valve 17 implemented as a downhole relief valve to reduce or equalize the pressure difference. This "pressure self-balancing" logic may enable use of the tool without the need for separate anchors/slips for anchoring the tool in the well in addition to the packers, since the forces acting on the tool from the pressure differences are monitored and controlled in real-time and may be kept below a pre-defined limit. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The logics as included in the control units in the downhole tool may be implemented by means of hardware comprising several distinct elements, and by means of a suitably programmed computer. In the device claim enumerating several means, several of these means may be embodied by one and the same item of hardware.

The invention claimed is:

1. A downhole tool conveyable on an electric coiled tubing string, the downhole tool comprising:

an electric actuator, wherein the electric actuator is a linear electric actuator operated by means of an electromotor;

at least one sensor; and a first control unit adapted to receive and interpret data from the at least one sensor, wherein the first control unit is adapted to operate the electric actuator in a closed-loop configuration based on data received from the at least one sensor, whereby one or more elements of the downhole tool may be operated in closed-loop configuration by the electric actuator.

2. A downhole tool conveyable on an electric coiled tubing string, the downhole tool comprising:

an electric actuator;

at least one sensor; and a first control unit adapted to receive and interpret data from the at least one sensor, wherein the first control unit is adapted to operate the electric actuator in a closed-loop configuration based on data received from the at least one sensor, whereby one or more elements of the downhole tool may be operated in closed-loop configuration by the electric actuator, and wherein the at least one sensor is adapted to measure work exerted by the electric actuator when operating one or more of the elements of the downhole tool.

3. The downhole tool according to claim 1, wherein the first control unit is adapted to operate the electromotor to operate one or more of the elements of the downhole tool, via the linear actuator, at a first power at an initial stage of an operation and at a second power, which is lower than the first power, at a later stage of the operation.

4. The downhole tool according to claim 1, wherein the electric actuator is configured to operate one or more of the elements of the downhole tool, and an element of the one or more elements operable by the electric actuator is an expandable sealing element expandable to an expanded state to a sealing engagement with an inside of a pipe string in a wellbore.

5. A downhole tool conveyable on an electric coiled tubing string, the downhole tool comprising:

an electric actuator;

at least one sensor; and a first control unit adapted to receive and interpret data from the at least one sensor, wherein the first control unit is adapted to operate the electric actuator in a closed-loop configuration based on data received from the at least one sensor, whereby one or more elements of the downhole tool may be operated in closed-loop configuration by the electric actuator, and wherein the electric actuator is configured to operate one or more of the elements of the downhole tool, and an element of the one or more elements operable by the electric actuator is an expandable sealing element expandable to an expanded state to a sealing engagement with an inside of a pipe string in a wellbore; and further comprising:

a plurality of sensors including the at least one sensor, the plurality of sensors comprising a first pressure sensor for measuring pressure in the well and a second pressure sensor for simultaneously measuring pressure in the well, wherein the first pressure sensor is provided above the sealing element on the downhole tool and the second pressure sensor is provided below the sealing element on the downhole tool.

6. A downhole tool conveyable on an electric coiled tubing string, the downhole tool comprising:

an electric actuator;

at least one sensor; and a first control unit adapted to receive and interpret data from the at least one sensor, wherein the first control unit is adapted to operate the electric actuator in a closed-loop configuration based on data received from the at least one sensor, whereby one or more elements of the downhole tool may be operated in closed-loop configuration by the electric actuator, and wherein the electric actuator is configured to operate one or more of the elements of the downhole tool, and an element of the one or more elements operable by the electric actuator is an expandable sealing element expandable to an expanded state to a sealing engagement with an inside of a pipe string in a wellbore; and further comprising:

a plurality of sensors including the at least one sensor, the plurality of sensors comprising a first sensor provided above the sealing element on the downhole tool, and a second sensor provided below the sealing element on the downhole tool, wherein the downhole tool is provided with a mandrel extending axially at least across a portion of the downhole tool where the expandable sealing element is provided, the mandrel including a first axial bore in the mandrel that allows for fluid circulation through the tool and a second axial bore in a wall of the mandrel, and wherein real-time communication with, and optionally power to, the second sensor is provided by means of one or more wires provided in the second axial bore in the wall of the mandrel.

7. The downhole tool according to claim 6, wherein the downhole tool is an isolation tool, and wherein the downhole tool further comprises:

a plurality of expandable sealing elements adapted to isolate a section of the wellbore therebetween, wherein the plurality of expandable sealing elements includes the expandable sealing element and a second expandable sealing element, and wherein the at least one sensor is provided above the expandable sealing element and a second sensor is provided below the second expandable sealing element; and one or more fluid ports provided between a pair of expandable sealing elements of the plurality of sealing elements and adapted to be in fluid communication with the electric coiled tubing string.

8. The downhole tool according to claim 1, wherein the electric actuator is configured to operate one or more of the elements of the downhole tool, and an element of the one or more elements operable by the electric actuator is an anchor for anchoring the downhole tool in the well.

9. A downhole tool conveyable on an electric coiled tubing string, the downhole tool comprising:

an electric actuator;

at least one sensor; and a first control unit adapted to receive and interpret data from the at least one sensor, wherein the first control unit is adapted to operate the electric actuator in a closed-loop configuration based on data received from the at least one sensor, whereby one or more elements of the downhole tool may be operated in closed-loop configuration by the electric actuator, and wherein the downhole tool includes a plurality of sensors including the at least one sensor for measuring the position of the electric actuator, the speed of the electric actuator, and the force exerted by the electric actuator.

10. A downhole tool assembly including a downhole tool according to claim 1, wherein the downhole tool assembly further comprises:

the electric coiled tubing string to which the downhole tool is connected; and a second control unit provided topside and adapted to communicate with the first control unit.

11. The downhole tool assembly according to claim 10, wherein the first control unit, upon loss of communication with the second control unit, is adapted to:

automatically reset the one or more elements of the downhole tool to a fail-safe or idle position.

12. The downhole tool assembly according to claim 10, wherein the first control unit is adapted to recognize a command in the form of a mechanical or acoustic signature transmitted via the electric coiled tubing.

13. A method for operating a downhole tool assembly according to claim 10, wherein the method comprises the steps of:

receiving data from a plurality of sensors, including the at least one sensor; and executing, by the first control unit, a command to operate the electric actuator from the second control unit based on data received from the at least one sensor in a closed loop configuration.

14. The method according to claim 13, wherein the method, prior to executing a command, further includes the step of:

sending the command from the second control unit, located topside, to the first control unit on the downhole tool;

receiving, at the first control unit, the command from the second control unit; and in response to receiving the command from the second control unit, operating the electric actuator based on data received from the at least one sensor in the closed loop configuration.

15. The method according to claim 13, wherein the method further comprises the steps of:

sensing a pressure in the well by means of one or more of the plurality of sensors; and if the pressure is outside a pre-defined interval, adjusting the pressure in the well by operating a pump and/or valve device from the first control unit in closed loop configuration.

16. The method according to claim 13, wherein the method further comprises the steps of:

by means of the first control unit, sensing that electronic communication with topside has been lost;

in response to sensing that electronic communication with topside has been lost, automatically operating the one or more elements of the downhole tool to a fail-safe or idle position.

17. The method according to claim 13, wherein the method further comprises the steps of:

by means of the first control unit, sensing that electronic communication with topside has been lost;

by means of the first control unit, sensing an acoustic or mechanical signal with a pre-set signal pattern; and in response to sensing the acoustic or mechanical signal with the pre-set signal pattern, operating the one or more elements of the downhole tool to a fail-safe or idle position.

18. A downhole tool conveyable on an electric coiled tubing string, the downhole tool comprising:

an electric actuator;

at least one sensor; and a first control unit, in signal communication with the at least one sensor, adapted to receive and interpret data from the at least one sensor, wherein the first control unit is adapted to operate the electric actuator in a closed-loop configuration based on data received from the at least one sensor, whereby one or more elements of the downhole tool may be operated in closed-loop configuration by the electric actuator, wherein the at least one sensor is adapted to measure work exerted by the electric actuator when operating one or more of the elements of the downhole tool, and wherein the first control unit is adapted to stop the operation of the element when the work measured by the at least one sensor reaches a predefined limit.

19. A downhole tool conveyable on an electric coiled tubing string, the downhole tool comprising:

an electric actuator;

at least one sensor; and a first control unit, in signal communication with the at least one sensor, adapted to receive and interpret data from the at least one sensor, wherein the first control unit is adapted to operate the electric actuator in a closed-loop configuration based on data received from the at least one sensor, whereby one or more elements of the downhole tool may be operated in closed-loop configuration by the electric actuator, wherein the at least one sensor is adapted to measure work exerted by the electric actuator when operating one or more of the elements of the downhole tool, and wherein an element of the one or more elements operable by the electric actuator is a valve in the downhole tool.

* * * * *